US005988595A

United States Patent [19]

DeVincent

[11] Patent Number: 5,988,595

[45] Date of Patent: Nov. 23, 1999

[54] CHAIN LINK FENCE INSTALLING DEVICE AND METHOD OF USING THE SAME

[76] Inventor: Bryan DeVincent, 74 Sargent St., Winthrop, Mass. 02152

[21] Appl. No.: 08/895,316

[22] Filed: Jul. 16, 1997

[51] Int. Cl.[6] ..... B21F 9/00

[52] U.S. Cl. ..... 254/243; 254/199; 254/131

[58] Field of Search ..... 254/199, 243, 254/261, 131

[56] References Cited

U.S. PATENT DOCUMENTS

| | | | |
|---|---|---|---|
| 528,994 | 11/1894 | Smith | 254/199 |
| 1,555,367 | 2/1925 | Hall | 254/261 X |
| 3,945,087 | 3/1976 | Miller | 254/131 |
| 4,097,024 | 6/1978 | Schreyer | 254/243 X |
| 4,250,769 | 2/1981 | Herring | 254/243 X |
| 4,264,055 | 4/1981 | Strange | 254/243 |
| 4,512,554 | 4/1985 | Racine | 254/131 X |
| 4,991,893 | 2/1991 | Gordon et al. | 254/131 X |
| 5,360,199 | 11/1994 | Speier | 254/131 X |
| 5,370,365 | 12/1994 | Kuretich | 254/131 X |
| 5,642,591 | 7/1997 | Eddie | 254/131 X |
| 5,713,559 | 2/1998 | McClarin et al. | 254/131 X |

FOREIGN PATENT DOCUMENTS

| | | | |
|---|---|---|---|
| 23038 | 10/1905 | Sweden | 254/243 |
| 21055 | 6/1906 | Sweden | 254/243 |

*Primary Examiner*—Donald P. Walsh
*Assistant Examiner*—Emmanuel M. Marcelo
*Attorney, Agent, or Firm*—Lambert & Garrison, PLLC; Scott B. Garrison; Gary E. Lambert

[57] ABSTRACT

A method and apparatus for transferring a weight of chain link mesh fence and holding the fence in position while a single installer secures the fence. The apparatus includes a lever arm, at least one tip for engaging an intersection of chain link mesh, a pivot point between the lever arm and tip, a hook attached to the lever arm by a flexible tether or connector which allows the chain link mesh to remain in place once engaged. The installer first places the pivot point on the fence post and pivots the chain link mesh upward to the desired height. Then the installer attaches the hook to an intersection of fence so that the flexible tether is taut. Once done, the forces are balanced on each side of the pivot point of the apparatus and the installer can release the tool and work with both hands to install the fence.

2 Claims, 3 Drawing Sheets

CHAIN LINK FENCE INSTALLING DEVICE AND METHOD OF USING THE SAME

BACKGROUND

Chain link fences have been well recognized as a cost-effective and quickly built method of cordoning off large spaces. One difficulty associated with the installation of chain link fence from an installer's view point is that the chain link is heavy. Although on a per square foot basis, many other types of fencing materials are heavier, chain link wire mesh has a unique property not many other fencing materials possess. That is, that the chain link wire mesh is provided in spools of continuous sections. Typically installation is accomplished by unrolling a spool of such chain link wire mesh along the ground at the base of vertical uprights and horizontal members to which the mesh is to be attached. One installer walks along the length of chain link wire mesh positioning the mesh as close to the finished embodiment as possible, while freeing the mesh from entanglements along the ground. At least one other installer clips, wire ties, or by some other attachment means attaches the chain link wire mesh to the horizontal members. The mesh is now hung similar vertically and allowed to slide horizontally along the horizontal members. At this point, the installers stretch the mesh horizontally and clip or wire tie the mesh to the vertical uprights.

Although variations exist on this method of installation, the process of installing chain link fence is essentially as described. The typical installation requires at least two people, one to assist in holding the chain link mesh to a desired height, while the other secures it in place. The Applicant is aware of one method which eliminates the need for two installers, U.S. Pat. No. 4,261,557 to Johnson describes a guide roller device which purportedly eliminates the need for two installers.

The Johnson device consists of a rolling mechanism which enables an installer to hook portions of chain link mesh to hook elements. An installer using a plurality of such Johnson devices could then roll the chain link mesh along a horizontal member of the fence. Feasibly, a single person could attach at one end a length of chain link mesh to a vertical and with proper placement of a plurality of Johnson devices hooked to said mesh, that person could stretch the mesh and fasten the other end of said chain link mesh. However, the Johnson device does not appear to overcome the problems associated with the intersection of a vertical upright and a horizontal member.

Typically chain link fences are constructed so that every so many feet, there is an intersection between a horizontal member and a vertical upright. This is because the weight of the chain link mesh hanging from the horizontal member must be supported every so often. Were the span between vertical uprights sufficiently long, the horizontal members would be subject to failure due to the load suspended therefrom. As stated above, the obvious solution to this problem is to situate vertical uprights at desired space intervals. However, rolls of chain link mesh are longer in total length than are the distances between any two vertical uprights. As such, when a plurality of Johnson devices are used to hang chain link wire mesh from the horizontal members, it is likely that during the tensioning process one of the intersections between a vertical upright and horizontal member will be caused to interfere with at least one of the Johnson devices as the Johnson devices are caused to roll along said upright.

SUMMARY

What is needed is a device which will enable an individual to hang chain link mesh fence without help yet overcome the disadvantages associated with the Johnson device. Applicant has created such a device. Applicant's device comprises a leverage arm containing a curved arc near one end of the device which forms a bearing surface between the device and either vertical uprights or horizontal members. At the opposite end of the arm attached by a cord or chain is a hook. Use of the device is had by first uncoiling a length of chain link mesh such that it leans against the vertical uprights and horizontal members to which it will be affixed. The end of the device containing the arc is engaged with the chain link mesh while the arc rests upon the horizontal member. The individual installing the fence pushes downward on the opposite end which levers the chain link mesh upward as it pivots about the horizontal member. Once the desired height has been reached, the individual grasps the hook and engages it with the chain link mesh at a point where the cord or chain is fully extended and under tension. Now the device can be released because the tension of the hook and cord offsets the tension at the limiting end of the device. In essence, the device remains where it was secured, keeping the chain link mesh at the position it was set. This enables the individual to tie the chain link mesh to the horizontal member per normal procedures but eliminates the need for another party to hold the chain link mesh at the desired height. During the tensioning process, the procedure is identical except that the device is used upon the vertical uprights rather than the horizontal members. It is therefore an object of this invention to provide a device which enables a single person to rapidly install and secure chain link fencing.

Another object of the present invention is to provide a tool which is simple to manufacture and use yet streamlines the procedures for installing chain link fence.

Yet another object of the device is to provide a lightweight tool which works on the principle of leverage to effectively lift chain link mesh, a portion at a time into proper position.

Still another object of the present invention is to provide a method of securing the tool in place allowing the user to do other work without affecting the position of the chain link mesh.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawing.

DETAILED DESCRIPTION OF THE PREFERRED EMBODIMENT

Figure 1:
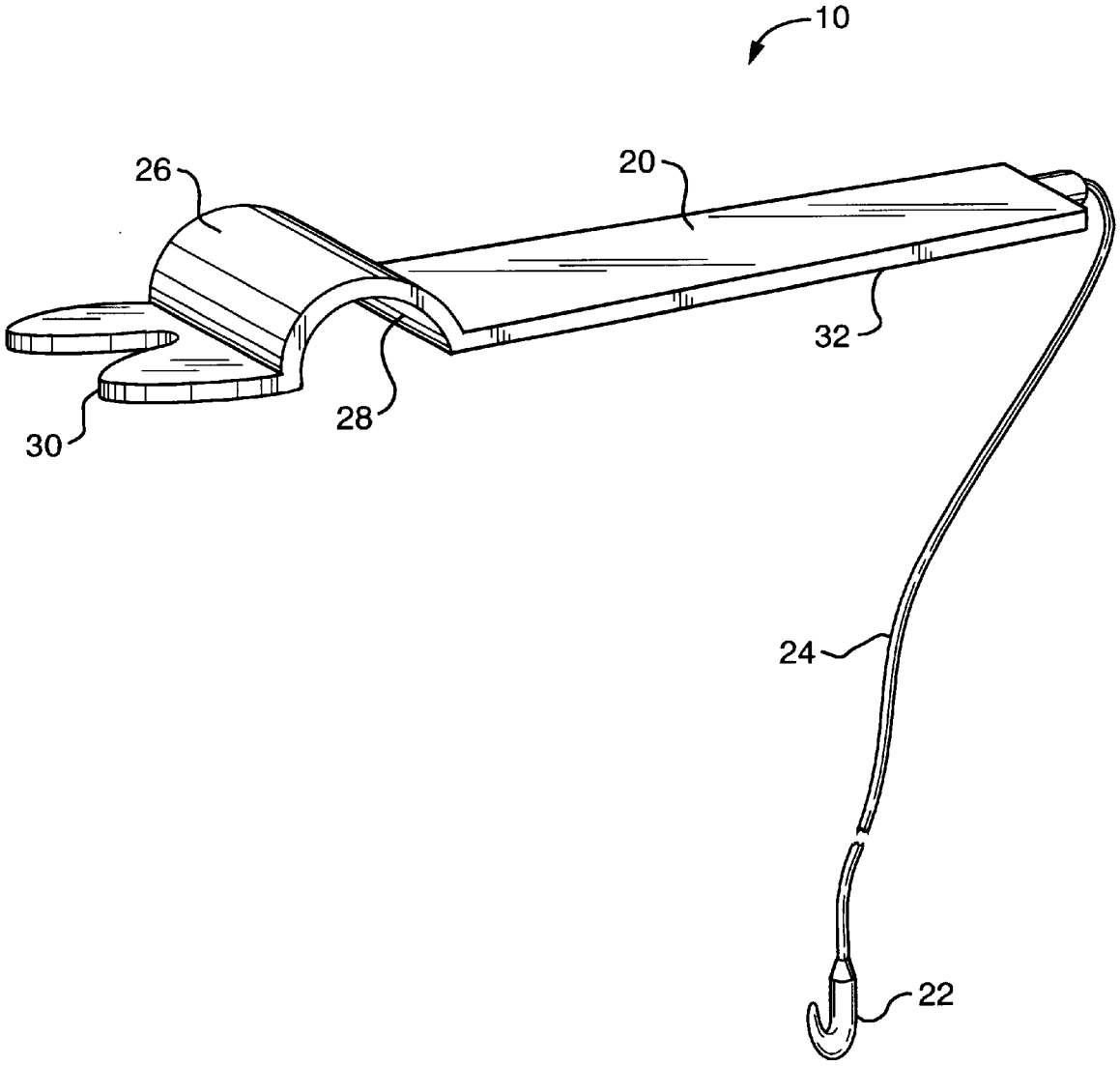
FIG. 1 is a three quarter perspective view of a preferred embodiment of the apparatus according to the present invention.

With reference to FIG. 1, a preferred embodiment of the apparatus 10 is depicted. Apparatus 10 comprises a lever arm 20, a hook 22, and a flexible connecting means 24 disposed between the lever arm 20 and hook 22. Lever arm

20 at a point along its length comprises a concave or arced portion 26 wherein a concave face of said portion 26 forms a bearing surface 28. The bearing surface 28 is configured so that it slidingly rotates upon a support structure portion of a chain link fence. Typically, the support structure comprising a portion of the chain link fence includes both horizontal members or rails and vertical supports or posts. These support structures are commonly fabricated from tubes of circular cross section. Hence, bearing surface 28 is configured into the shape of a portion of an arc. The actual radius of curvature to arced portion 26 or bearing surface 28 is not important, it being only necessary that bearing surface 28 substantially contact over its face that portion of the support structure upon which it is positioned. In fact the Applicant is aware of at least two standard sizes of support structure currently used for chain link fencing; 1⅜ inch and 1⅝ inch piping. Therefore at least two different radii are contemplated for arced portion 26. As stated, there will be at least two preferred radii of arced portion 26 which will allow bearing surface 28 to substantially come into sliding contact with said support structure. However, the Applicant does envision that the radius of arced portion 26 can be even greater than the radius of a support structure upon which it is placed, this difference can be large and would not necessarily defeat the purpose of the invention, as described further herein.

Figure 2:
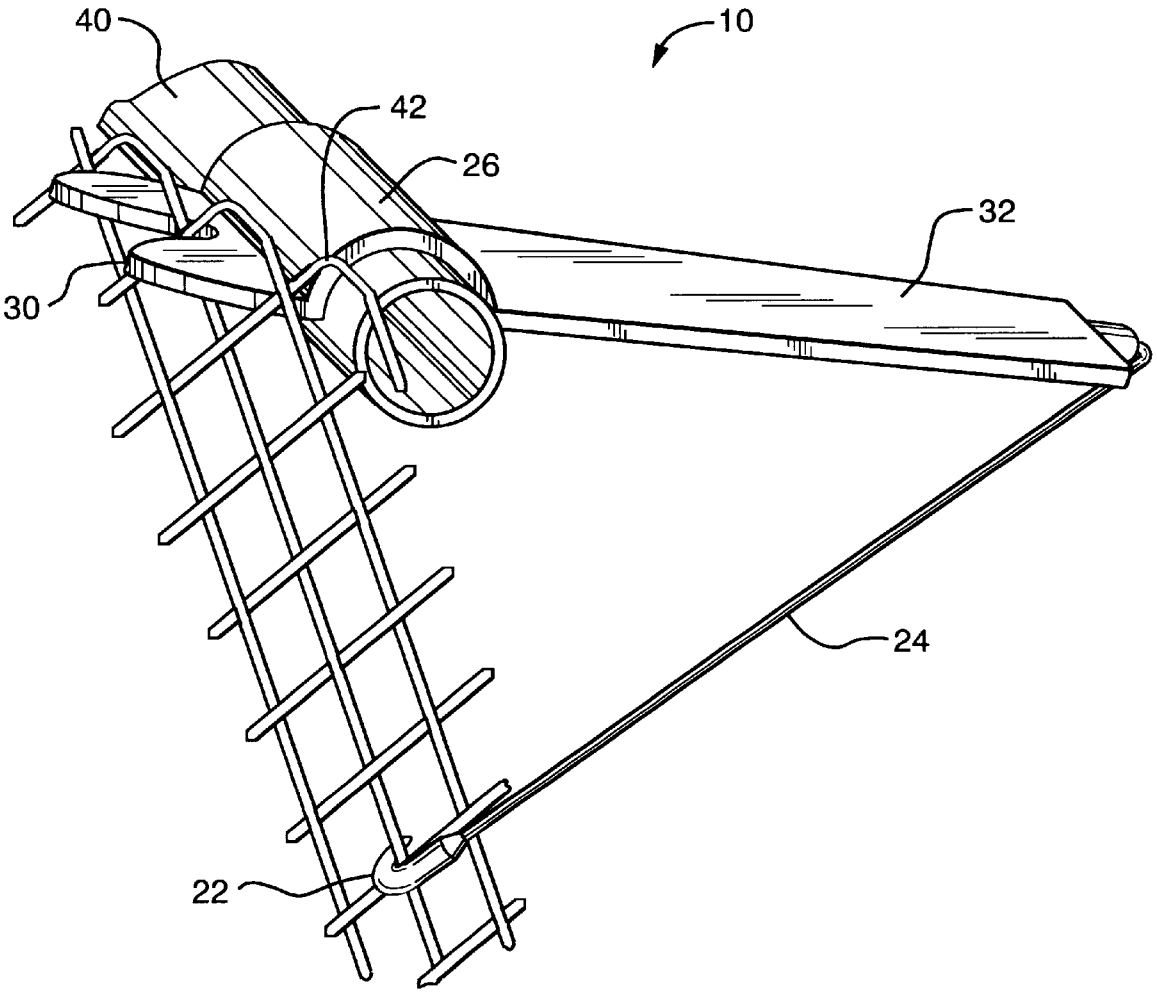
FIG. 2 is a three quarter perspective view of a slightly different embodiment of the FIG. 1 apparatus showing it in one possible use configuration.

As FIG. 2 depicts, the device is engaged by laying arced portion 26 onto the support structure, in this case horizontal member 40 so that bearing surface 28 slidingly pivots about horizontal member 40. Tip 30 is next caused to engage with the chain link mesh at an intersection of two wire elements 42. Once tip 30 is engaged, the individual presses downward on handle portion 32 causing apparatus 10 to pivot thereby resulting in a portion of the chain link mesh being lifted effortlessly. As can be seen, arced portion 26 of lever arm 20 is preferred to be disposed substantially more toward one end than the other so as to produce an effective lever arm. The location of arced portion 26 upon lever arm 20 is guided more by the physics of leverage more than anything else. However, Applicant has determined that a handle portion 32 approximately 18 inches in length with an approximately one inch tip 30 with the arced portion 26 disposed therebetween makes a most efficient tool. However, the actual position of arced portion 26 can vary so long as its relative position with respect to tip 30 enables an individual to easily lift the chain link mesh by pushing in the opposite direction on the handle portion 32.

Once the chain link mesh is lifted the desired height, the hook 22 is attached to another intersection of two wire elements 42. This is accomplished by removing all slack from the flexible connecting means 24. Once the slack is removed, the hook 22 is attached at an intersection 42 which keeps the flexible connecting means 24 as tight as possible. Hook 22 should be engaged at as great a distance as practicable from tip 30, limited of course by the length of the connecting means 24. As should be apparent, the chain link mesh will now be lifted some distance and will be held stationary in place. Use of the present device allows an individual to install chain link fencing without the help of others. Once the chain link mesh is held stationary, the individual need not hold apparatus 10 any longer, and can more permanently secure the chain link mesh to the support structure at his or her convenience before removing the apparatus.

Figure 3:
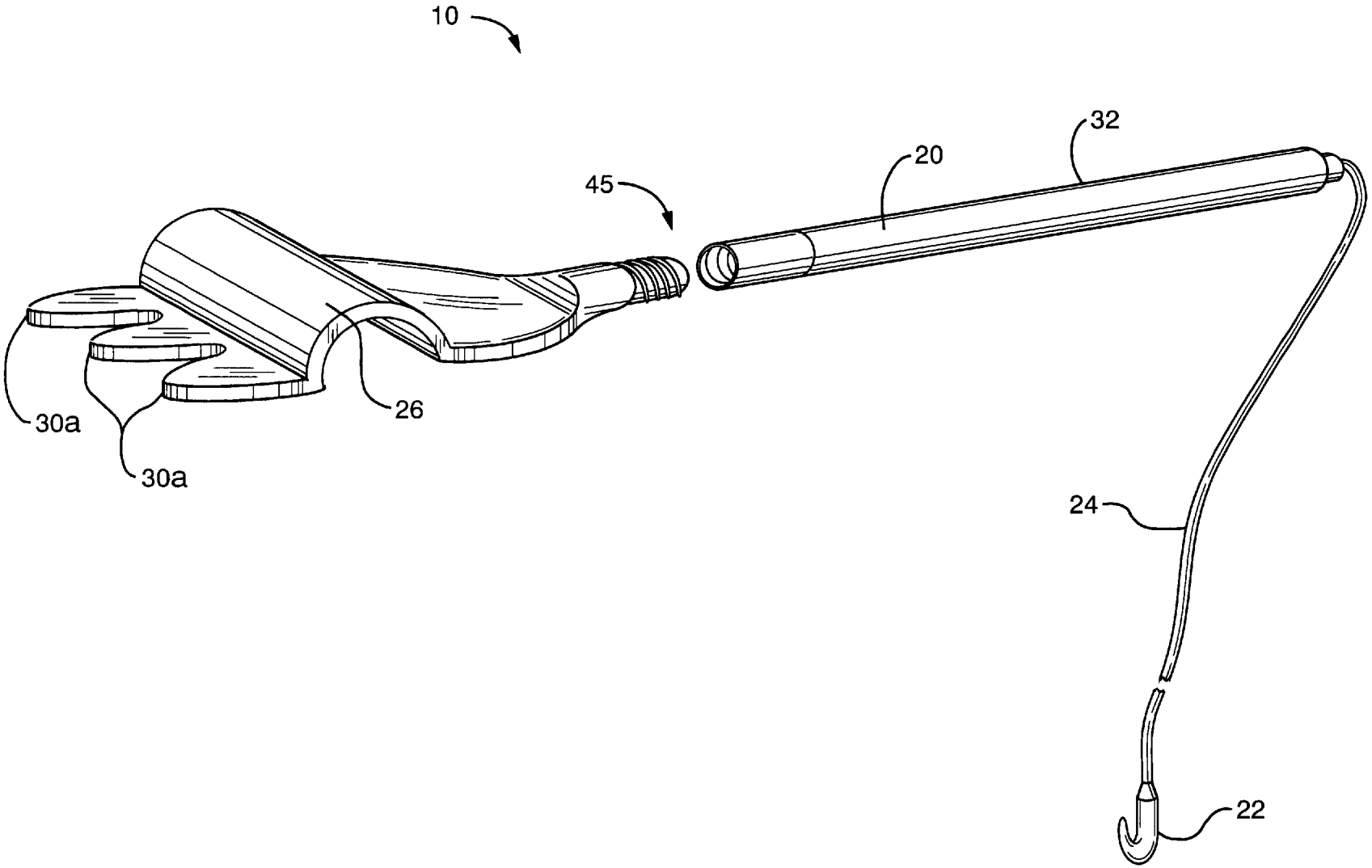
FIG. 3 is a three quarter perspective view of another preferred embodiment of the present invention having separate detachable sections and multiple tips.

The length of flexible connecting means 24 is not important, but the Applicant has found a length of 18 to 20 inches to be most suitable. The flexible connecting means 24 can be rope, cable, chain or some other material capable of withstanding the tensile forces to which it is subjected. Whether it is chain, line, wire, or cable is unimportant, a key feature being that it is essentially non-stretchable. As for the material that lever arm 20 is to be comprised, it is important that the device withstand cyclical use. Therefore Applicant considers a metal or metal composite to be best suited for the use intended. Though in FIGS. 1 and 2 the lever arm 20 is depicted as a bar stock type device, FIG. 3 depicts an alternative preferred embodiment comprising hollow pipe stock. It should be noted that the actual cross-sectional shape of the device is not critical to its function and as such many embodiments can be manufactured dependent upon economics. Continuing to refer to FIG. 3 it should be noted that the apparatus 10 can be made in sections, in this case but not limited to two, joined at a joint 45. This is desirable for two very important reasons. First, disassembly of the device makes it easier to store and transport within a tool box. Second, disassembly enables the use of longer lever arms when desired simply by the substitution of a different length arm. FIG. 3 further depicts an alternative tip 30*a*. This tip comprises a plurality of individual engaging elements which each engage a separate intersection of two wire elements 42. This is desirable especially for heavy sections of chain link mesh or large heights such as commonly found on tennis courts. Applicant has found that by spreading the load over a number of intersections the possibility of stretching any wire elements 42 at any one intersection is minimized. Applicant prefers the use of three such engaging elements, however Applicant is aware that two or more would suffice with the number of such engaging elements limited by the practicality of engaging them with said intersections.

The method of making and using the device detailed above constitute the inventor's preferred embodiment and an alternate embodiment to the invention. The inventor is aware that numerous configurations are available which would provide the desired results. While the invention has been described and illustrated with reference to a specific embodiment, it is understood that these other embodiments may be resorted to without departing from the invention. Therefore the form of the invention set out above should be considered illustrative and not as limiting the scope of the following claims.

What is claimed is:

1. An apparatus for installing and tensioning a chain link mesh fence comprising;

a lever arm portion, having a first and a second end;

at least two tips, arranged side-by-side on the first end;

a pivot portion disposed upon said lever arm portion substantially toward said first end;

a hook for engaging chain link mesh and;

a flexible connecting means disposed between and operably connecting said hook to said second end of said lever arm portion.

2. An apparatus according to claim 1 wherein said at least two tips is three tips.

* * * * *